US009484653B1

(12) United States Patent
Chen

(10) Patent No.: US 9,484,653 B1
(45) Date of Patent: Nov. 1, 2016

(54) POWER SOCKET TERMINAL

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 14/968,925

(22) Filed: Dec. 15, 2015

(30) Foreign Application Priority Data

Sep. 10, 2015 (CN) ..... 2015 2 0697937 U

(51) Int. Cl.
*H01R 11/12* (2006.01)
*H01R 13/02* (2006.01)

(52) U.S. Cl.
CPC ..... *H01R 13/02* (2013.01)

(58) Field of Classification Search
CPC ..... H01R 13/2492
USPC ..... 439/856, 857
See application file for complete search history.

(56) References Cited

U.S. PATENT DOCUMENTS 2,917,612 A * 12/1959 Chabot ..... H01H 1/42 200/254
3,551,613 A * 12/1970 Cocoa ..... H01H 1/50 200/16 B
4,607,907 A * 8/1986 Bogursky ..... H01R 12/82 439/682
4,734,041 A * 3/1988 Bruchmann ..... H01R 12/82 439/637
5,868,590 A * 2/1999 Dobbelaere ..... H01R 13/18 439/839
5,868,690 A * 2/1999 Eischen, Sr. ..... A61H 9/0078 128/DIG. 20
5,997,347 A * 12/1999 Robinson ..... H01R 13/426 439/517
6,222,708 B1 * 4/2001 Severson ..... H05K 7/1457 361/2
6,299,492 B1 * 10/2001 Pierini ..... H01R 13/26 439/884
6,488,549 B1 * 12/2002 Weller ..... H01R 13/6485 439/181
6,652,322 B2 * 11/2003 Ito ..... H01R 12/721 439/637
6,776,635 B2 * 8/2004 Blanchfield ..... H01R 9/091 439/181
6,932,660 B2 * 8/2005 Roepke ..... H01M 2/20 439/856
7,677,934 B2 * 3/2010 Piovesan ..... H01R 13/112 439/818
8,113,887 B2 * 2/2012 Osawa ..... H01R 12/73 439/637
8,281,598 B2 * 10/2012 Gerendas ..... F23R 3/007 60/753
9,112,292 B2 * 8/2015 Ogura ..... H01R 13/11
9,379,459 B2 * 6/2016 Grzywok ..... H01R 4/16

* cited by examiner

*Primary Examiner* — Neil Abrams
(74) *Attorney, Agent, or Firm* — Mark M. Friedman

(57) ABSTRACT

A power socket terminal is provided, comprising a base plate, a pair of asymmetric elastic arms and a receiving space defined by the base plate and the pair of the elastic arm. First contact portions of the pair of the elastic arms are located at the same level, and second contact portions thereof are staggered in a vertical direction. Some second contact portions are higher than the first contact portions, and other second contact portions are lower than the first contact portions. Using this design, when the plug is inserted into and mated with the power socket terminal of the present invention, the plug will be subjected to balance forces and be kept in a correct insertion state for forming a normal power circuit. Therefore, the power socket terminal of the present invention has the characteristics of high security, good electric property and reliable connection.

4 Claims, 5 Drawing Sheets

POWER SOCKET TERMINAL

BACKGROUND OF THE INVENTION

1. Field of the Invention

The present invention relates to a power socket terminal for transmitting power, and more particularly to a power socket terminal with an asymmetric structure, which can realize high security.

2. Description of the Prior Art

At present, there are more and more requirements for a large current terminal. The application range of the large current terminal is also more and more wide. The large current terminal has the characteristics of safe, reliable, convenient, high conductivity and so on.

As shown in FIG. 1, a power socket terminal 90 is directly mounted on an electronic device to act as a power socket connector. The power socket terminal 90 has a pair of bilateral symmetry elastic clip arms 91. When a plug 92 is inserted into between the two elastic clip arms 91, strictly speaking, the plug 92 should be vertical, but it is not the truth. Actually, the two elastic clip arms 91 made by punching are not completely in accordance with an ideal design size, but will produce some micro differences in the size of a certain tolerance range during punching. For example, the height of contact points 910 of the two elastic clip arms 91 may produce a deviation along an upper-lower direction. When the plug 92 is inserted into therebetween, because normal forces applied on left and right sides of the plug 92 are not at the same level and unbalanced, the plug 92 will be twisted and be in an incorrect insertion state. Therefore, the prior power socket terminal 90 has a design defect to cause its safety to be reduced.

Hence, it is necessary to provide a new power socket terminal having advantages of high security, good electric property and reliable connection.

BRIEF SUMMARY OF THE INVENTION

A primary object of the present invention is to provide a power socket terminal with characteristics of high security, good electric property and reliable connection, which ensure that a plug can be subjected to balance forces and be kept in a correct insertion state for forming a normal power circuit.

The other object and the advantage of the present invention may be further understood from the technical features disclosed by the present invention.

To achieve the above object of the present invention, the present invention adopts the following technical solution.

The present invention provides a power socket terminal, which comprises a base plate, a first elastic arm formed by bent from one side of the base plate, a second elastic arm formed by bent from the other side of the base plate and a receiving space defined by the base plate, the first elastic arm and the second elastic arm. The first elastic arm includes a row of first sub elastic arms, each of which has a first fixed end connected to the base plate and formed by bent toward the receiving space, a first free end formed by bent away from the receiving space, and a first contact portion connecting the first fixed end and the first free end and facing the receiving space. The first contact portions of the row of the first sub elastic arms are located at the same level. The second elastic arm and the first elastic arm are asymmetrically disposed on the base plate. The second elastic arm includes a row of second sub elastic arms, each of which has a second fixed end connected to the base plate and formed by bent toward the receiving space, a second free end formed by bent away from the receiving space, and a second contact portion connecting the second fixed end and the second free end and facing the receiving space. The second contact portions of the row of the second sub elastic arms are staggered along a vertical direction.

In one embodiment, the second contact portions of the second sub elastic arms located on two sides of the row of the second sub elastic arms have the same height in the vertical direction, and are lower than the second contact portion of the second sub elastic arm located on the middle of the row of the second sub elastic arms.

In one embodiment, the second contact portion of the second sub elastic arm located on the middle thereof is higher than the first contact portion of the first sub elastic arms along the vertical direction, and the second contact portions of the second sub elastic arms located on the two sides thereof are lower than the first contact portions of the first sub elastic arms.

In one embodiment, the second sub elastic arms located on the two sides thereof have the same width, which is smaller than the width of the second sub elastic arm located on the middle thereof.

In one embodiment, the first sub elastic arms located on two sides of the row of the first sub elastic arms have the same width, which is smaller than the width of the first sub elastic arm located on the middle of the row of the first sub elastic arms In comparison with the prior art, the power socket terminal of the present invention employs one pair of the asymmetric elastic arms. The first contact portions of the pair of the elastic arms are located at the same level, and the second contact portions are not located at the same level, but disposed in a staggered arrangement. Some second contact portions are higher than the first contact portions, and other second contact portions are lower than the first contact portions. Using this design, when the plug is inserted into and mated with the power socket terminal of the present invention, the plug will be subjected to balance forces and be kept in a correct insertion state for forming a normal power circuit. Therefore, the power socket terminal of the present invention has the characteristics of high security, good electric property and reliable connection.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
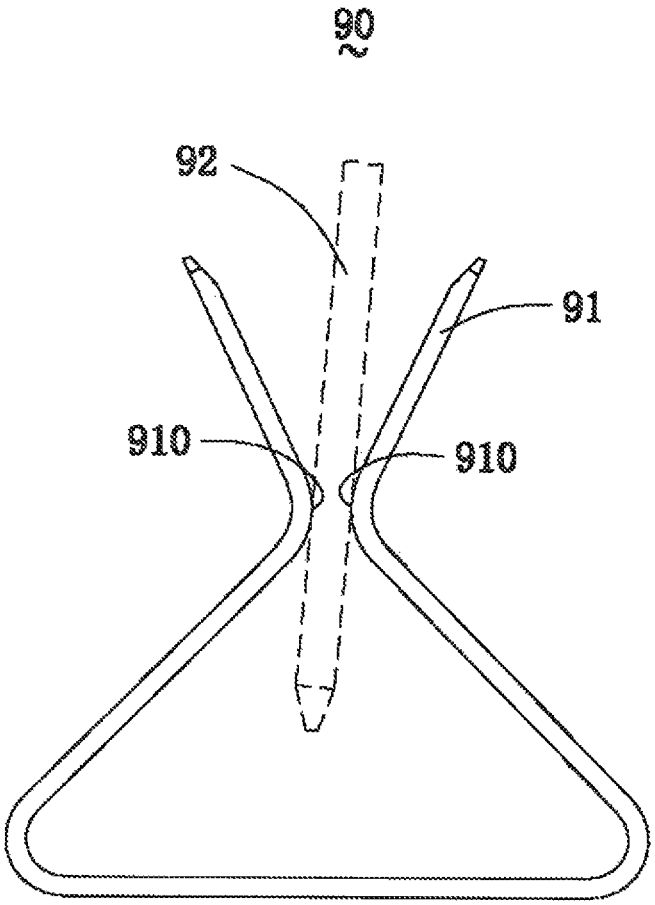
FIG. 1 (PRIOR ART)
FIG. 1 is a plan view of a power socket terminal of the prior art, wherein the dotted part indicates a plug being inserted into the power socket terminal.
Figure 2:
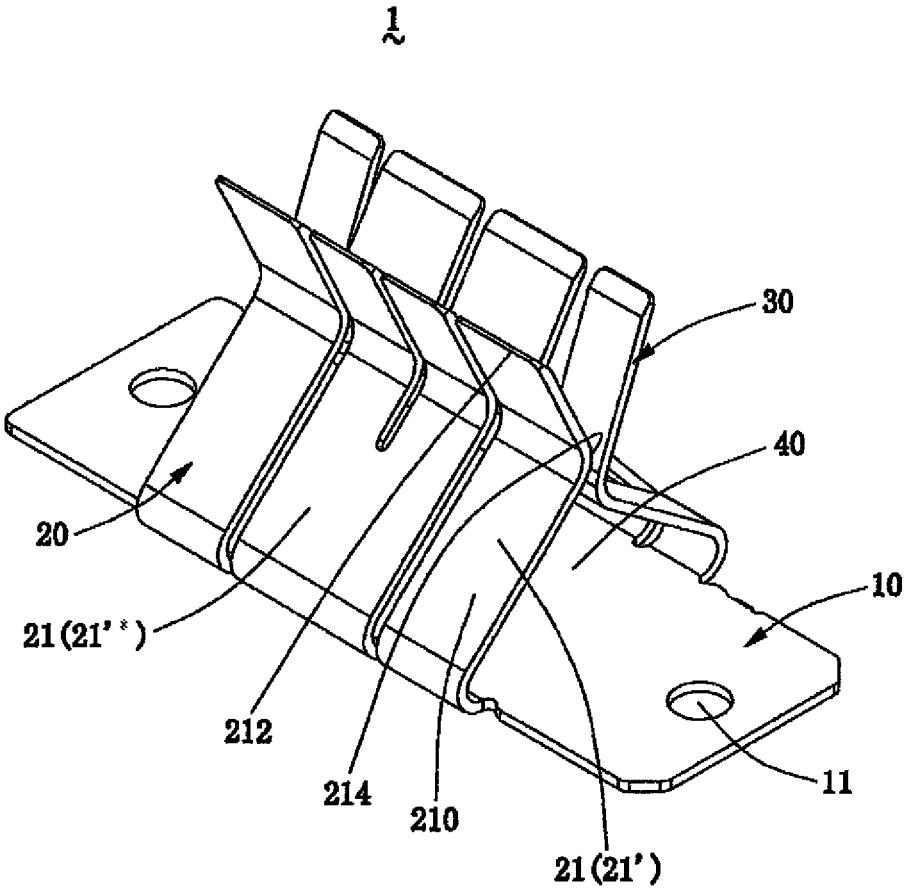
FIG. 2 is a perspective view of a power socket terminal of the present invention, which mainly shows the detail structure of a first elastic arm.
Figure 3:
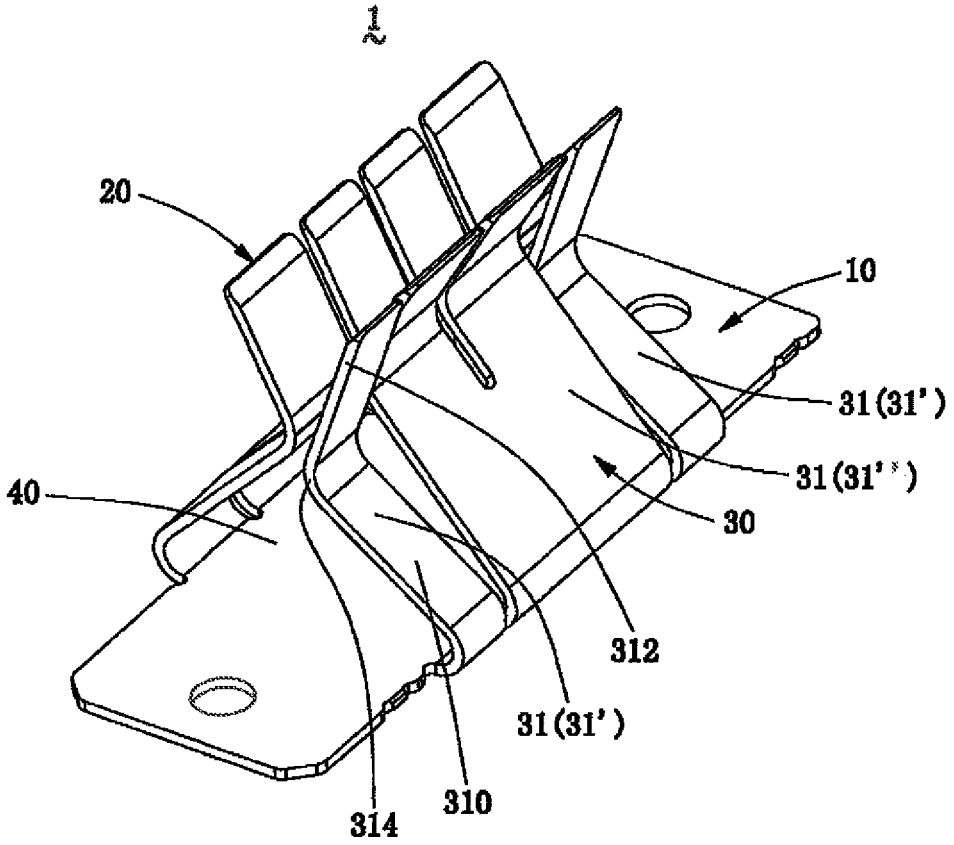
FIG. 3 is a perspective view of the power socket terminal of the present invention in another direction, which mainly shows the detail structure of a second elastic arm.
Figure 4:
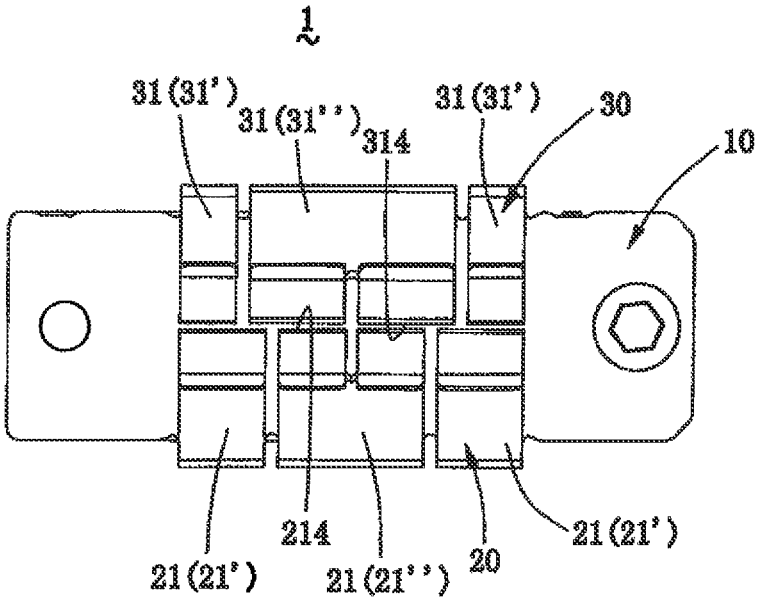
FIG. 4 is a top plan view of the power socket terminal of the present invention.
Figure 5:
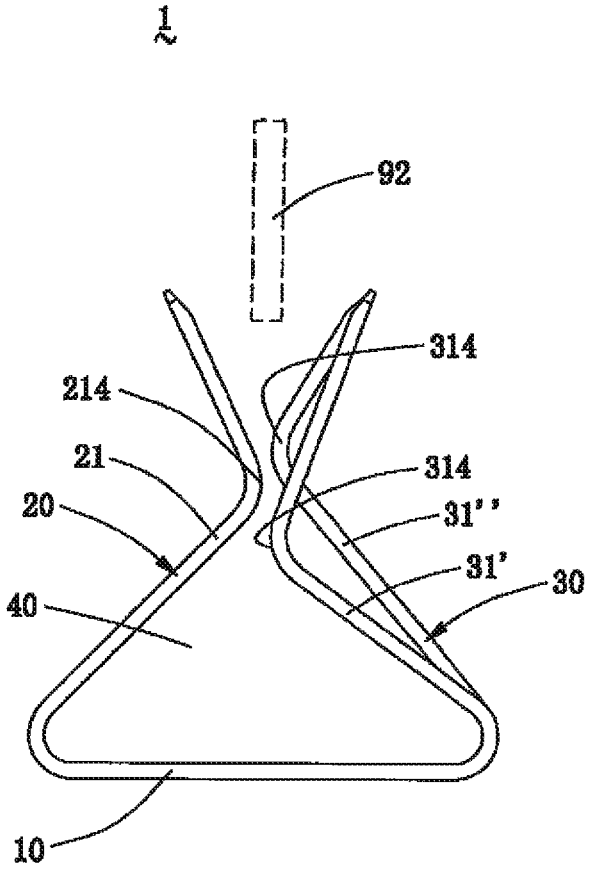
FIG. 5 is a side view of the power socket terminal of the present invention.

Please refer to FIGS. 2 to 5, FIG. 2 is a perspective view of a power socket terminal 1 of the present invention, which mainly shows the detail structure of a first elastic arm 20; FIG. 3 is a perspective view of the power socket terminal 1 of the present invention in another direction, which mainly shows the detail structure of a second elastic arm 30; FIG. 4 is a top plan view of the power socket terminal 1 of the present invention; and FIG. 5 is a side view of the power socket terminal 1 of the present invention.

As shown in FIGS. 2 to 5, the power socket terminal 1 of the present invention includes a base plate 10, a pair of asymmetric elastic arms 20, 30, and a receiving space 40 defined by the base plate 10 and the pair of the asymmetric elastic arms 20, 30.

In the embodiment, as shown in FIG. 2, the base plate 10 has a top surface and a bottom surface, which are horizontal. The base plate 10 disposes two symmetric retaining holes 11 formed on two ends thereof and passing through the top and bottom surfaces thereof. When the base plate 10 is mounted on an electronic device (not shown in FIG. 2), a pair of screws can be used to pass through the corresponding retaining holes 11 to fix the base plate 10 to the electronic device.

In the embodiment, as shown in FIG. 5, the receiving space 40 can receive a plug 92 inserted therein, so that the pair of the elastic arms 20, 30 and the plug 92 can form an electrical connection.

Please refer to FIGS. 2 to 5, the pair of the elastic arms 20, 30 forms a clip shape, one elastic arm 20 is bent from one side (e.g. a left side) of the base plate 10 to form a V shape and is called a first elastic arm 20, and the other elastic arm 30 is bent from the other side (e.g. a right side) of the base plate 10 to form a V shape and is called a second elastic arm 30.

Please refer to FIG. 2, the first elastic arm 20 includes a row of first sub elastic arms 21, which are separated and arranged in a row. Each first sub elastic arm 21 has an inclined first fixed end 210 connected to the base plate 10 and formed by bent toward the receiving space 40, a first free end 212 formed by bent away from the receiving space 40, and a first contact portion 214 connecting the first fixed end 210 and the first free end 212 and facing the receiving space 40. The first contact portions 214 of these first sub elastic arms 21 are located at the same level. Namely, these first sub elastic arms 21 are disposed in parallel.

Please refer to FIG. 3, the second elastic arm 30 includes a row of second sub elastic arms 31, which are separated. Each second sub elastic arm 31 has an inclined second fixed end 310 connected to the base plate 10 and formed by bent toward the receiving space 40, a second free end 312 formed by bent away from the receiving space 40, and a second contact portion 314 connecting the second fixed end 310 and the second free end 312 and facing the receiving space 40. Because these second sub elastic arms 31 are not arranged in parallel, the second contact portions 314 thereof are not located at the same level, but staggered along a vertical direction. Specifically, in this embodiment, the second contact portions 314 of the second sub elastic arms 31', which are separately located on two sides of the row of the second sub elastic arms 31, are located at one level; and the second contact portion 314 of the second sub elastic arm 31" located on the middle of the row of the second sub elastic arms 31 is located at the other level. More specifically, the vertical heights of the second contact portions 314 of the two-side second sub elastic arms 31' are the same, but are lower than that of the second contact portion 314 of the middle second sub elastic arm 31". That is, in the vertical direction, the second contact portion 314 of the middle second sub elastic arm 31" is higher than the second contact portions 314 of the two-side second sub elastic arms 31'.

Please further refer to FIG. 5, the second contact portion 314 of the middle second sub elastic arm 31" is higher than the first contact portions 214 of the first sub elastic arms 21, and the second contact portions 314 of the two-side second sub elastic arms 31' are lower than the first contact portions 214 of the first sub elastic arms 21. Therefore, the power socket terminal 1 of the present invention does not need to consider the height difference caused by manufacturing tolerances or errors. The power socket terminal 1 of the present invention can reduce the insertion force of the plug 92, and ensure that the plug 92 can be subjected to balance forces and be kept in a correct insertion state.

It needs to be noted that the second elastic arm 30 of the present invention can not be limited to the described above. Actually, in other embodiments, the second contact portion 314 of the middle second sub elastic arm 31" can be significantly lower than the second contact portions 314 of the two-side second sub elastic arms 31', so this design also can realize the object of the present invention.

In the embodiment, as shown in FIGS. 2 and 4, the first elastic arm 20 includes three first sub elastic arms 21. The first sub elastic arms 21' located on two sides of the three first sub elastic arms 21 have the same width, which is smaller than the width of the first sub elastic arm 21" located on the middle of the three first sub elastic arms 21. Moreover, the middle first sub elastic arm 21" is cut from the top thereof through the first contact portion 214, thereby reducing the insertion force of the plug 92.

In the embodiment, as shown in FIGS. 3 and 4, the second elastic arm 30 also includes three second sub elastic arms 31. The second sub elastic arms 31' located on the two sides of the three second sub elastic arms 31 have the same width, which is smaller than the width of the second sub elastic arm 31" located on the middle of the three second sub elastic arms 31. Moreover, the middle second sub elastic arm 31" is cut from the top thereof through the second contact portion 314, thereby reducing the insertion force of the plug 92.

As described above, the power socket terminal 1 of the present invention employs one pair of the asymmetric elastic arms 20, 30. The first contact portions 214 are located at the same level, namely they have the same height. The second contact portions 314 are not located at the same level, but arranged in a staggered design. Some second contact portions 314 are higher than the first contact portions 214, and other second contact portions 314 are lower than the first contact portions 214. Using this design, when the plug 92 needs to be inserted into the receiving space 40 and mated with the power socket terminal 1, the plug 92 will first contact with some second contact portions 314, next will contact with the first contact portions 214, and then will electrically contact with other second contact portions 314. This design can not only reduce the insertion force, but also can make the plug 92 be subjected to balance forces and be kept in a correct insertion state for forming a normal power circuit. This design can resolve the prior question of the plug being twisted due to manufacturing tolerances or errors. Therefore, the power socket terminal 1 of the present invention has the characteristics of high security, good electric property and reliable connection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power socket terminal, comprising a base plate, a first elastic arm formed by bent from one side of the base plate, a second elastic arm formed by bent from the other side of the base plate and a receiving space defined by the base plate, the first elastic arm and the second elastic arm;

wherein the first elastic arm includes a row of first sub elastic arms, each of which has a first fixed end connected to the base plate and formed by bent toward the receiving space, a first free end formed by bent away from the receiving space, and a first contact portion connecting the first fixed end and the first free end and facing the receiving space; the first contact portions of the row of the first sub elastic arms being located at the same level; and the second elastic arm and the first elastic arm being asymmetrically disposed on the base plate; the second elastic arm including a row of second sub elastic arms, each of which has a second fixed end connected to the base plate and formed by bent toward the receiving space, a second free end formed by bent away from the receiving space, and a second contact portion connecting the second fixed end and the second free end and facing the receiving space; the second contact portions of the row of the second sub elastic arms being staggered along a vertical direction;

wherein the second contact portions of the second sub elastic arms located on two sides of the row of the second sub elastic arms have the same height in the vertical direction, and are lower than the second contact portion of the second sub elastic arm located on the middle of the row of the second sub elastic arms.

2. The power socket terminal as claimed in claim 1, wherein the second contact portion of the second sub elastic arm located on the middle thereof is higher than the first contact portion of the first sub elastic arms along the vertical direction, and the second contact portions of the second sub elastic arms located on the two sides thereof are lower than the first contact portions of the first sub elastic arms.

3. The power socket terminal as claimed in claim 2, wherein the second sub elastic arms located on the two sides thereof have the same width, which is smaller than the width of the second sub elastic arm located on the middle thereof.

4. The power socket terminal as claimed in claim 3, wherein the first sub elastic arms located on two sides of the row of the first sub elastic arms have the same width, which is smaller than the width of the first sub elastic arm located on the middle of the row of the first sub elastic arms.

* * * * *